US005909809A

United States Patent [19]

Franklin

[11] Patent Number: 5,909,809

[45] Date of Patent: Jun. 8, 1999

[54] ELASTIC BAND HOLDER

[75] Inventor: Larry A. Franklin, Pensacola, Fla.

[73] Assignee: Merit, Inc., Pensacola, Fla.

[21] Appl. No.: 08/958,000

[22] Filed: Oct. 22, 1997

Related U.S. Application Data

[63] Continuation of application No. 08/660,240, Jun. 7, 1996, abandoned.

[51] Int. Cl.[6] ..... B65D 85/00

[52] U.S. Cl. ..... 206/525; 206/805; 206/818

[58] Field of Search ..... 206/525, 526, 206/805, 303, 224, 818, 350, 371; 174/40 R, 45 R, 451 D; 446/122–124

[56] References Cited

U.S. PATENT DOCUMENTS

| | | | |
|---|---|---|---|
| 470,382 | 3/1892 | Kerstein | 174/40 R |
| 1,216,840 | 2/1917 | Ramsey et al. | 446/124 |
| 1,281,856 | 10/1918 | Shaw | 446/124 |
| 2,149,070 | 2/1939 | Poinan | 174/40 R |
| 2,471,682 | 5/1949 | Grob | 174/45 R |
| 2,950,338 | 8/1960 | Taylor | 174/40 R |
| 3,572,396 | 3/1971 | Hoffman et al. . | |
| 3,747,261 | 7/1973 | Salem | 446/124 |
| 3,918,132 | 11/1975 | McGahee . | |
| 4,058,209 | 11/1977 | Schmidt | 206/818 |
| 4,676,762 | 6/1987 | Ballard | 446/124 |
| 4,890,730 | 1/1990 | Kovac . | |
| 4,901,672 | 2/1990 | Rosenberger | 446/122 |
| 5,037,000 | 8/1991 | Selame . | |
| 5,069,647 | 12/1991 | Zuviria | 446/124 |
| 5,111,938 | 5/1992 | Soprano et al. | 206/597 |

*Primary Examiner*—Paul T. Sewell
*Assistant Examiner*—Luan K. Bui
*Attorney, Agent, or Firm*—Carlton Fields

[57] ABSTRACT

An elastic band holder is comprised of a generally rectangular-shaped or generally cylindrical-shaped body member having one or more concave slotted portions encompassing the body. The slotted portions can be disposed in either parallel or perpendicular orientation to one another. All corners and edges of the device are rounded in order to prevent elastic band shearing. One or more receptacles are located on the body to receive and hold additional objects such as pens, pencils, rulers, paper clips and the like. Mushroom-shaped and apple-core-shaped embodiments are also provided.

6 Claims, 2 Drawing Sheets

ELASTIC BAND HOLDER

This is a continuation of application Ser. No. 08/660,240 filed Jun. 7, 1996, now abandoned.

BACKGROUND OF THE INVENTION

1. Field of the Invention

The present invention relates to an elastic band holder having slotted portions defining elastic band receiving regions.

2. Background of the Prior Art

The need for holding and storing elastic or rubber bands has long been recognized. Elastic band storage devices have been proposed that facilitate quick and easy retrieval of the bands without the bands becoming entangled with one another.

Three general types of elastic band holders have been identified in the art. The first or ring type, exemplified by U.S. Pat. No. 3,918,132 to McGahee, utilizes a selectively closable wire loop onto which the elastic bands are loaded. Although this type of device is relatively simple, storage of the device itself becomes problematic, especially on a cluttered desk, as the elastic band laden wire loop becomes entangled with other objects thereby producing user frustration.

The second type of elastic band holder, exemplified by U.S. Pat. No. 5,037,000 to Selame, utilizes a box-like storage device having an aperture defining a band retrieval opening. This simple type of device suffers from the fact that means are not provided for preventing entanglement of the bands within the device. Once the bands are so entangled, the device looses its intended utility.

The third type of elastic band holder, exemplified by U.S. Pat. No. 4,890,730 to Kovac, provides a body member having slotted portions wherein the bands are wrapped around the device within the slotted portions. Although the Kovac device provides an effective elastic band holding means, each of Kovac's five embodiments suffer from limited utility.

Therefore, there is a need in the art for an elastic band holder that circumferentially holds elastic and rubber bands and prevents the bands from becoming entangled. Such a device should be free standing and should be easily holdable by a user from any side. The proposed device should have continuous slotted portions so that the elastic bands do not get sheared by the device. Ideally, the device may have additional object receptacles located thereon.

SUMMARY OF THE INVENTION

The elastic band holder of the present invention addresses the aforementioned needs in the art. The elastic band holder circumferentially holds elastic bands, recessed within a band holding region, so that the bands do not become entangled with each other or with other objects. The device may be set on any surface due to recessed bands The elastic band holder of the present invention is comprised of a generally rectangular-shaped or generally circular-shaped body. One or more continues concave slotted portions or grooves of substantially constant radius encompass the outer edges of the body. The slotted portions or grooves can be disposed parallel to one another. Alternately, the slotted portions or grooves can be disposed perpendicular to one another. All edges of the rectangular-shaped solid are rounded as are all the corners.

One or more receptacles can be located on one or more faces of the solid for receiving and storing additional objects such as paper clips, pens and pencils, rulers, etc.

The elastic band holder of the present invention, which is self-standing, provides increased utility over similar devices in the art. By rounding the edges and corners of the device, and providing continuous concave slotted portions of substantially constant radius, the problem of elastic band shearing by the device is eliminated. This is a major improvement over other devices because many individuals find it necessary to hold or otherwise manipulate a small object when performing other tasks such as talking on the phone. The rubber band is the object of choice by many. Therefore, users will be able to manipulate the rubber held by the device without fear of shearing the bands.

As the device is generally rectangular-shaped or generally circular-shaped, it can be easily held by a user from any side, again placing an object into the user's hand for manipulation. By having rounded edges and corners, the device can be tossed up and down by the user without injury. The shape of the device gives it substantial additional object storage capacity.

Mushroom-shaped and apple-core-shaped embodiments are also provided.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1:
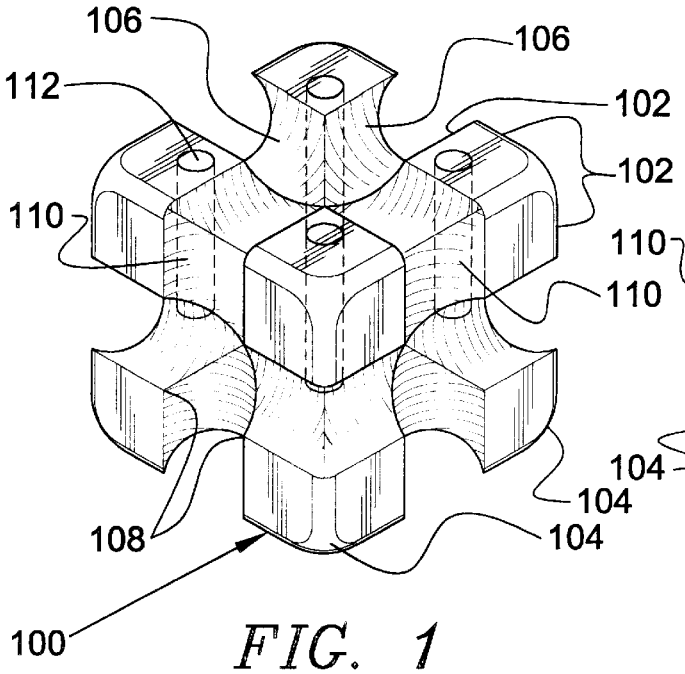
FIG. 1 is an isometric view of the elastic band holder of the present invention.
Figure 2:
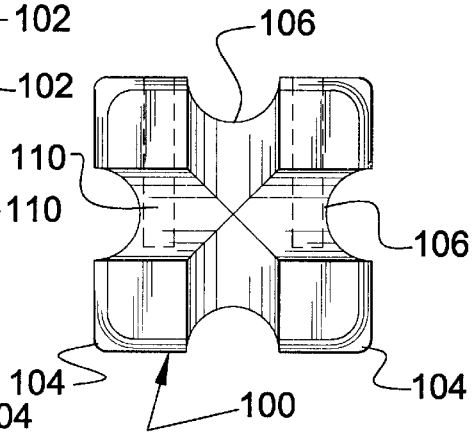
FIG. 2 is a side view of the elastic band holder.
Figure 3:
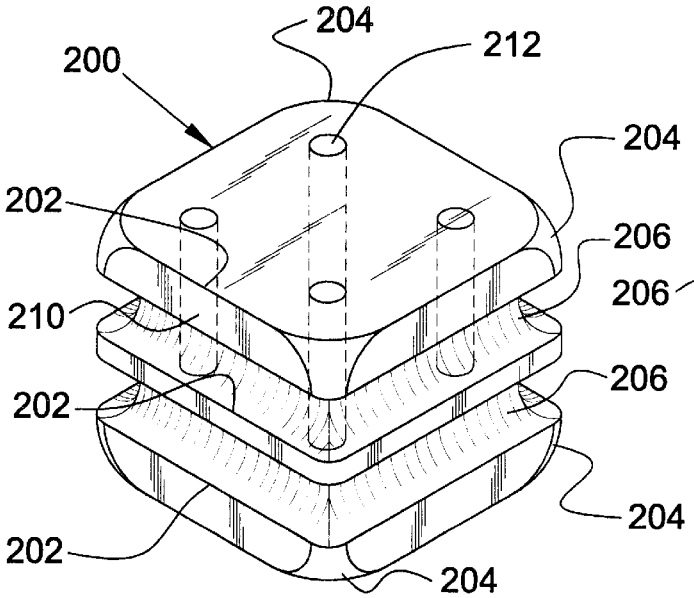
FIG. 3 is an isometric view of the elastic band holder having slotted portions disposed in generally parallel orientation.

Referring now to the drawings, specifically FIGS. 1–3, it is seen that the elastic band holder of the present invention is comprised of a generally rectangular-shaped body 100 made from any suitable material. The outer corners 102 of the body 100 are rounded as are all outer edges 104. One or more slotted portions or grooves 106, defining elastic band holding regions, encompass the body 100. Each slotted portion or grooves and a substantially constant radius 106 has a generally concave shape having an arcuate cross-section. The slotted portions 106 can be disposed in perpendicular orientation to one another, or as seen in FIG. 3, the slotted portions 106 can be disposed in parallel orientation to one another.

In order to utilize the elastic band holder, an elastic band is stretched and fitted over the body 100 and located over one of the slotted portions or grooves 106. The rounded nature of the corners 104 and the edges 102 prevent elastic band shearing during this procedure. The elastic band is permitted to partially retract and thereby be received within the target slotted portion 106. Ideally, the device will be dimensioned so that the elastic band held within the slotted portion 106 remains under partial tension. The meeting points 108 of any two legs of the slotted portion or grooves 106 are also rounded so that the partially tensioned elastic band is not sheared.

If desired, one or receptacles 110 can be located on one or more faces of the body 100. Each of the one or more receptacles 110 receives and stores an object such as a pen or pencil, ruler, paper clip, etc. If the receptacle 110 is designed to receive paper clips, then a magnet 112 can encompass the upper periphery of the receptacle 110 in order to help hold the paper clips within the receptacle 110.

Figure 4:
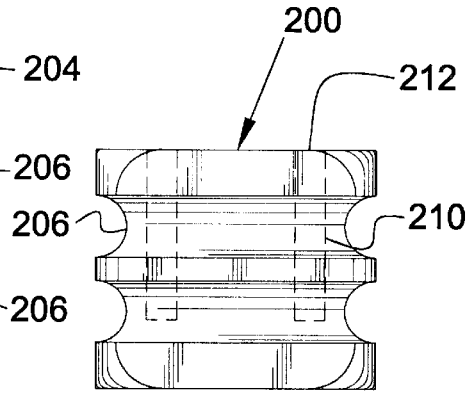
FIG. 4 is an isometric view of the elastic band holder in a generally cylindrical-shaped configuration.

As seen in FIG. 4, an alternate embodiment of the elastic band holder of the present invention is comprised of a generally cylindrical-shaped body 200 made from any suitable material. One or more slotted portions or grooves having an arcuate cross-section 206, defining elastic band holding regions, encompass the body 200. Each slotted portion 206 has a generally concave shape and a substantially constant radius. The slotted portions 206 can be disposed in perpendicular orientation to one another, or the slotted portions 206 can be disposed in parallel orientation to one another.

If desired, one or more receptacles 210 can be located on the body 200 at any suitable location. Each of the one or more receptacles 210 receives and stores an object such as a pen or pencil, ruler, paper clip, etc. An optional magnetic ring 212 can encompass the upper periphery of the receptacle 210.

Figure 5:
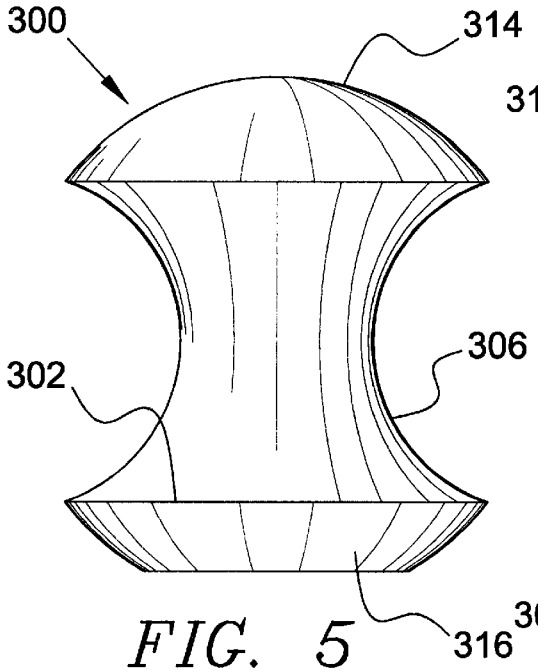
FIG. 5 is an isometric view of the elastic band holder in a generally apple-core-shaped configuration.
Figure 6:
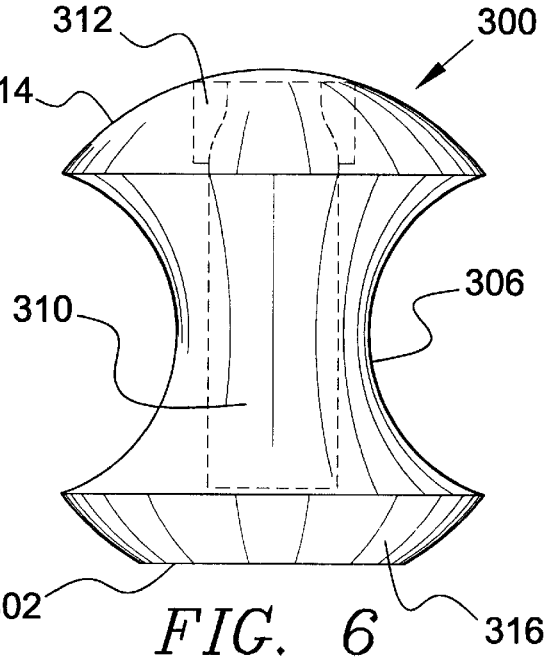
FIG. 6 is an isometric view of the elastic band holder in a generally apple-core-shaped configuration with optional receptacle.

FIGS. 5 and 6 illustrate a second alternate embodiment of the elastic band holder of the present invention having a body 300 in a shape similar to the shape of an apple core. A slotted portion groove 306 encompasses this embodiment. An optional receptacle 310 can be located on the top 314 of body 300. An optional magnetic ring 312 can encompass the upper periphery of the receptacle. All outer edges 302 of the body 300 are rounded. If desired, the base 316 of the body 300 can be weighted in order to increase device stability when placed on a desk.

Figure 7:
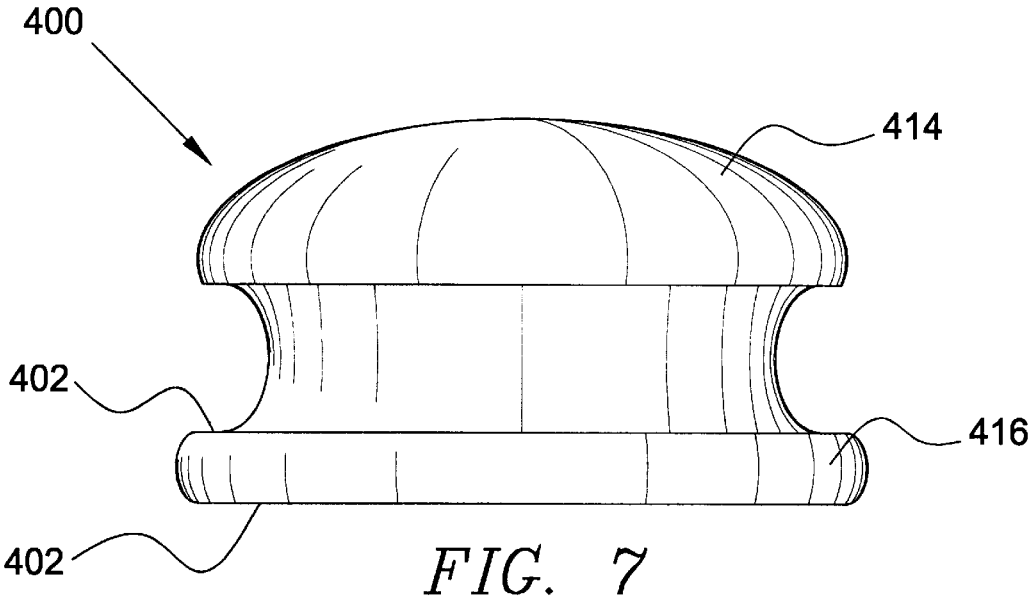
FIG. 7 is an isometric view of the elastic band holder in a generally mushroom-shaped configuration.

FIG. 7 illustrates a second alternate embodiment of the elastic band holder of the present invention having a body 400 in a shape similar to the shape of a mushroom. A slotted portion 406 encompasses this embodiment. All outer edges 402 of the body 400 are rounded. If desired, the base 416 of the body 400 can be weighted in order to increase device stability when placed on a desk.

While the invention has been particularly shown and described with reference to an embodiment thereof, it will be appreciated by those skilled in the art that various changes in form and detail may be made without departing from the spirit and scope of the invention.

I claim:

1. An elastic band holder, comprising:

a generally cubic-shaped body having at least one receptacle disposed within said body and a magnet encompassing the periphery of one of the at least one receptacle; and at least one generally concave slotted portion within said body having rounded internal edges encompassing an intermediate portion of said body.

2. The elastic band holder of claim 1, wherein the at least one slotted portion is in parallel orientation with a second slotted portion.

3. The elastic band holder of claim 1, wherein the at least one slotted portion is in perpendicular orientation with a second slotted portion.

4. An elastic band holder, comprising:

a generally cubic-shaped body having a plurality of outer edges and a plurality of rounded corners, said body including at least one receptacle disposed therein having a magnet encompassing the periphery of at least one of the at least one receptacle;

at least one generally concave first slotted portion having rounded internal edges encompassing the body; and at least one generally concave second slotted portion having rounded internal edges encompassing the body in perpendicular orientation to the at least one first slotted portion.

5. An elastic band holder, comprising:

a generally cube-shaped body having a plurality of mutually intersecting grooves formed in the respective faces of said body each said groove extending around the periphery of said body in a predetermined direction, and having an arcuate cross-sectional shape of substantially constant radius, said body further including a receptacle disposed within a face of said body and further including a magnet disposed about the periphery of said receptacle.

6. An elastic band holder, comprising:

a generally cube-shaped body having a plurality of mutually intersecting grooves formed in the respective faces of said body, each said groove extending around the periphery of said body in a predetermined direction, and having an arcuate cross-sectional shape of substantially constant radius, said cube-shaped body having a receptacle disposed within each face of said body and further including a magnet disposed about the periphery of said receptacle.

* * * * *